US006887079B1

(12) United States Patent
Robertsson et al.

(10) Patent No.: US 6,887,079 B1
(45) Date of Patent: May 3, 2005

(54) FIRING SIMULATOR

(75) Inventors: Hans Robertsson, Jönköping (SE); Arnold Fredriksson, Huskvarna (SE)

(73) Assignee: SAAB Training Systems AB, Huskvarna (SE)

( * ) Notice: Subject to any disclaimer, the term of this patent is extended or adjusted under 35 U.S.C. 154(b) by 0 days.

(21) Appl. No.: 09/914,956

(22) PCT Filed: Mar. 6, 2000

(86) PCT No.: PCT/SE00/00442

§ 371 (c)(1),
(2), (4) Date: Nov. 13, 2001

(87) PCT Pub. No.: WO00/53993

PCT Pub. Date: Sep. 14, 2000

(30) Foreign Application Priority Data

Mar. 10, 1999 (SE) ..... 9900843
Jul. 9, 1999 (SE) ..... 9902670

(51) Int. Cl.[7] ..... F41F 27/00

(52) U.S. Cl. ..... 434/22; 434/19; 434/21; 89/41.06

(58) Field of Search ..... 434/11, 16–23, 434/365; 42/106, 115, 116; 463/5; 89/41.06; 244/3.16, 3.11; 250/342, 346; 356/252; 345/9, 82

(56) References Cited

U.S. PATENT DOCUMENTS

| | | | | | |
|---|---|---|---|---|---|
| 3,792,535 | A | | 2/1974 | Marshall et al. | |
| 3,898,747 | A | * | 8/1975 | Marshall | 434/22 |
| 4,063,368 | A | * | 12/1977 | McFarland et al. | 434/22 |
| 4,264,309 | A | * | 4/1981 | Brooksby | 434/20 |
| 4,313,272 | A | * | 2/1982 | Matthews | 42/115 |
| 4,439,156 | A | * | 3/1984 | Marshall et al. | 434/12 |
| 4,464,974 | A | * | 8/1984 | Goda | 89/41.06 |
| 4,534,735 | A | * | 8/1985 | Allard et al. | 434/20 |
| 4,619,616 | A | * | 10/1986 | Clarke | 434/22 |
| 4,689,016 | A | * | 8/1987 | Eichweber | 434/22 |
| 4,794,430 | A | * | 12/1988 | Whittaker et al. | 356/252 |
| 4,844,476 | A | * | 7/1989 | Becker | 463/5 |
| 4,917,609 | A | * | 4/1990 | Eichweber | 434/20 |
| 4,955,812 | A | * | 9/1990 | Hill | 434/16 |
| 4,963,096 | A | * | 10/1990 | Khattak et al. | 434/21 |
| 5,001,836 | A | | 3/1991 | Cameron et al. | |
| 5,060,391 | A | | 10/1991 | Cameron et al. | |
| 5,476,385 | A | * | 12/1995 | Parikh et al. | 434/22 |
| 5,954,507 | A | * | 9/1999 | Rod et al. | 434/19 |
| 6,123,288 | A | * | 9/2000 | Kenyon | 244/3.16 |
| 6,174,169 | B1 | * | 1/2001 | Gerber | 434/11 |
| 6,406,298 | B1 | * | 6/2002 | Varshneya et al. | 434/21 |

FOREIGN PATENT DOCUMENTS

| | | | | |
|---|---|---|---|---|
| GB | 2159255 A | * | 11/1985 | F41G/3/26 |
| GB | 2300904 | | 11/1996 | |
| WO | 95/30123 | | 11/1995 | |
| WO | 95/30124 | | 11/1995 | |

* cited by examiner

*Primary Examiner*—Joe H. Cheng
(74) *Attorney, Agent, or Firm*—Swidler Berlin LLP

(57) ABSTRACT

An alignment device for alignment of a weapon and a weapon simulator mounted on the weapon. The weapon is provided with a sight and the weapon simulator is equipped with a first device arranged to emit an electromagnetic simulator beam exiting along a simulator axis. The alignment apparatus includes a second device arranged to generate an alignment beam along an alignment axis. The angle between the simulator axis and the alignment axis is fixed and known. A reflection device is arranged to reflect the alignment beam into the sight. An adjuster is arranged to collectively guide the alignment axis and the simulator axis during the alignment of the simulator axis with the sight so that the axes during the alignment maintain the fixed relative angular relationship.

28 Claims, 4 Drawing Sheets

FIRING SIMULATOR

TECHNICAL AREA

The invention concerns a simulator for simulating firing. The simulator is intended for mounting onto a weapon with a sight.

THE PRIOR ART

During simulated firing, the simulator emits a laser beam or a beam of electromagnetic radiation that has been generated by another technique than using a laser. The radiation can be detected by one or several detectors belonging to a target system mounted on the target. The emitted radiation, for example laser radiation, has different intensities in different directions of radiation, whereby these are collectively termed the laser lobe. If the radiant intensity from the laser lobe at a particular distance from the emitter and in a particular direction exceeds a detection level at any detector on the target, a simulated effect of firing with the weapon towards the target system that lies in the said direction and at the said distance is obtained.

When a simulator is attached to a weapon, the direction of fire of the simulator must be aligned with the direction of fire of the weapon. This can be achieved by aiming the weapon with the aid of its ordinary sight towards a target that is designed to be sensitive to the simulated firing of the simulator. The simulator is fired, and one observes how the hits fall on the target in relation to the direction of firing of the weapon. If there is any deviation, the direction of firing of the simulator is adjusted by means of an adjustment device built into the simulator, until the weapon and the simulator are co-aligned.

This method is often unwieldy and takes a great deal of time, since the method is iterative. Furthermore, the target must be arranged so that it can indicate exactly where the simulator hits, in order for the adjustment to be carried out reasonably rapidly.

Arrangement of the target thus becomes complex and expensive, which means that the number of adjustment devices per trainee in a unit must be limited during firing training using weapons by means of the use of a simulator. This means that the trainees must queue in order to carry out the adjustment, and considerable time must be allocated for preparing for the training, losing valuable training time.

Patent document WO 95/30124 describes a simulator with improved properties. The firer does not need to carry out the adjustment himself/herself, since the simulator is designed for the connection of an electromechanical adjustment head that can align the firing direction of the simulator to the sight of the weapon. This method can give a considerable increase in speed of the process.

Patent document WO 95/30123 describes a device that is used according to the aforementioned patent document in order to carry out the alignment automatically. It is clear that this device also is complex and expensive, and even if the alignment procedure is more rapid, a problem arises also here with the formation of queues that tends to require a long time in preparation for the training, since the method according to the said documents is still based on observation of the results of firing the simulator in a target system.

DESCRIPTION OF THE INVENTION

A device and a method for the simulation of firing by means of a weapon are described according to the aspect of the invention. This is carried out with a simulator, mounted on a weapon with a sight, with the simulator arranged to emit an electromagnetic simulator beam exiting along a simulator axis. Furthermore, the simulator is arranged to emit a visible alignment beam along an alignment axis, which forms a fixed and known angle with the aforementioned simulator axis.

The term "axis" is here used to describe the axis of symmetry of the directions of propagation of the respective beams.

The simulator contains a means of adjustment to collectively control both of the aforementioned axes, the simulator axis and the alignment axis, so that they maintain their fixed and known relative angular relationship during the adjustment.

The alignment beam is made visible in the weapon's sight by means of a reflection device.

The alignment beam can generate a guide mark, which, when it is viewed in the weapon's sight, indicates the error in direction between the simulator axis and the sight. This makes it possible for the firer simply to align the sight with the simulator axis with the aid of the means of adjustment.

The invention is otherwise characterised by the particular properties specified in the claims.

An advantage of a simulator according to the aspect of the invention is that it becomes possible not only in association with an exercise initially to align the simulator and the weapon after the simulator has been attached to the weapon, but also to check at intervals during the progress of the exercise that the alignment is still correct. A simulator on a light weapon is usually so placed on the weapon that it is exposed to blows and knocks, not least during exercises in forest, in connection with getting into and out of vehicles and during training in built-up areas, whereby an alignment that has been carried out may easily be disturbed. The trainees are given the opportunity by the invention to check, and if necessary adjust, the alignment of the simulator with the weapon reasonably easily.

A further major advantage is that the alignment device is small, simple and cheap, and that it can, in principle, be carried by every soldier who uses a weapon of a type that can be equipped with a simulator according to the invention.

The alignment device can be an integral part of the simulator or it can be a part that is easily attached, and which requires a minimum of space. In this way, it should be possible for a soldier to carry the alignment device without inconvenience during an exercise.

DESCRIPTION OF THE EMBODIMENTS

Figure 1:
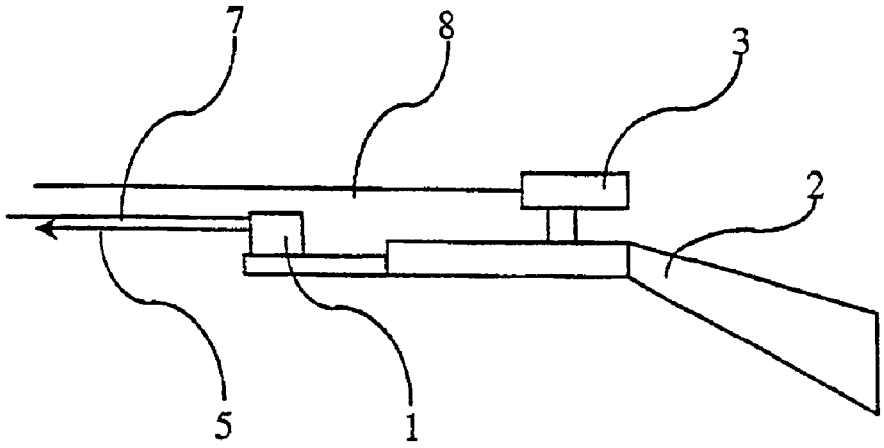
FIG. 1 shows a simulator on a weapon and specifies the sighting axis, the simulator axis and the alignment axis.

In the following, a number of embodiments according to the aspect of the invention will be described, supported by the figures. A simpler version is described in the first embodiment, in which the simulator axis and the alignment axis are made to be parallel, that is, the fixed angle between the axes in this embodiment is zero degrees.

A simulator 1 is mounted onto a weapon 2 equipped with a sight 3. A simulator beam 4 is generated in the simulator 1 along a simulator axis 5. The simulator also emits an alignment beam 6 along an alignment axis 7, which is parallel to the simulator axis 5. The weapon's sight 3 defines a sighting axis 8, and it is this sighting axis that defines the direction in which a shot will leave the weapon 2 when firing with live ammunition.

The simulator axis 5 of the simulator is to be brought to be parallel with the sighting axis 8. It would be possible to allow the alignment beam 6 to hit a target and observe in the sight 3 an alignment mark 9 made by the alignment beam. This may be associated, however, with a number of practical difficulties, such as that it may be difficult to observe the alignment beam in a situation of high ambient light. Further, a parallax error arises since the axes 5, 8 are placed at a certain distance from each other, which must be compensated for.

Figure 8:
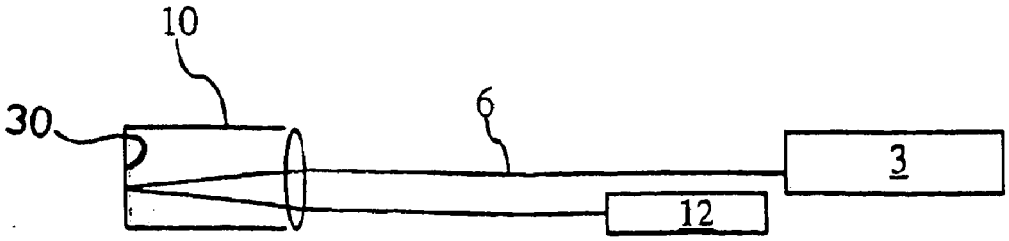
FIG. 8 shows the use of a collimator to return the alignment beam towards the sight.

If one instead places the target in the focal plane of a closed optical system (a collimator 10), the ambient light will be less of a problem. Such a collimator 10 must have a diameter that allows both the alignment axis 7 and the sighting axis 8 simultaneously to pass through the optical system of the collimator 10, as is shown in FIG. 8.

In cases in which the sighting axis 8 and the alignment axis 7 are separated by a considerable amount, it may be easier to use a reversing prism 11 in order to guide the alignment beam 6 to the sight 3.

Figure 6:
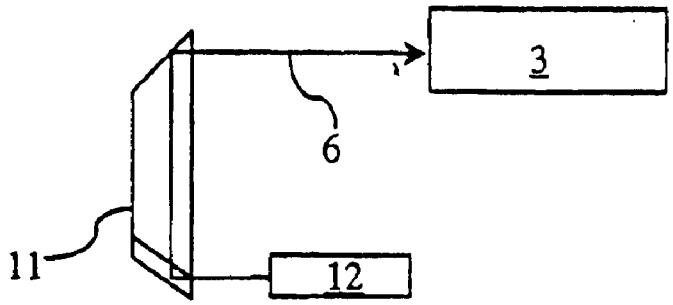
FIG. 6 shows bow a reversing prism column returns the alignment beam.

A reversing prism has the property of returning incident light in exactly the opposite direction, with a parallel displacement that is determined by the design of the prism, as is shown in FIG. 6.

Figure 7:
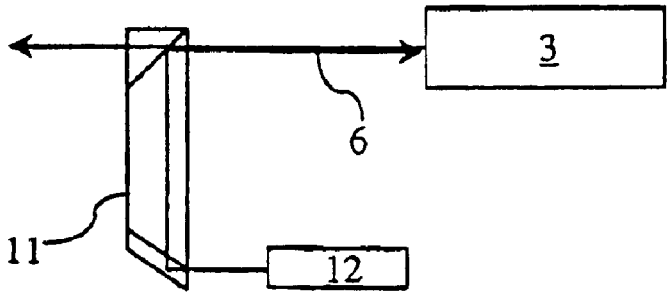
FIG. 7 shows a transparent prism column which makes it possible to see through the column from the sight.

If the prism itself 11 is placed, as a result of the placement of the simulator 1, within the sight 3 (for example between the bead and the rear sight) as shown in FIG. 7, then it is an advantage if the prism 11 is provided with a semi-transparent section so that the prism does not block the sight.

Figure 4:
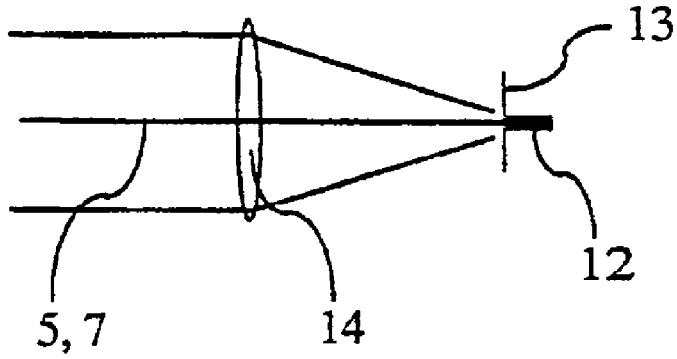
FIG. 4 shows the laser emitter and the alignment beam emitter.

If the simulator is to function in a stable manner, it is an advantage if both the simulator beam 4 and the alignment beam 6 are generated by the same optical system. Here, a laser emitter 12 is used to generate the simulator beam, and this laser emitter 12 is placed in the focal plane of an optical system. In this case, it is an advantage to place a reticle 13, which generates the alignment beam 6, in the same focal plane as the laser 12 and to connect these, that is the laser and the reticle, with a fixed mechanical connection. This arrangement using a common optical system, represented here in the form of a lens 14, and a stable mutual anchoring of the laser and the reticle in the simulator provides a simple method of ensuring that the alignment axis and the simulator axis are parallel. See FIG. 4.

Figure 5:
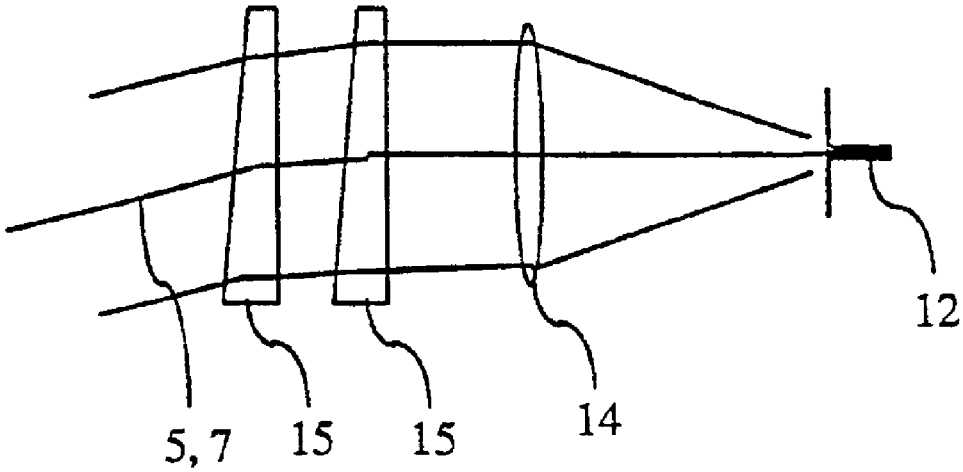
FIG. 5 shows an adjustment device for the collective adjustment of the directions of the simulator axis and the alignment axis.

The collective adjustment of these two axes, the alignment axis 7 and the simulator axis 5, becomes very simple in this case. Either the optical system can be suspended in mechanically adjustable gimbals, or optical redirection elements can be used, for example a pair or rotatable optical wedges 15, in order to achieve adjustment of the direction of the axis (FIG. 5).

It is appropriate to create the alignment beam 6 by allowing a lamp or light-emitting diode to illuminate the reticle 13. Alternatively, ambient light can be guided onto the reticle.

Figure 2A:
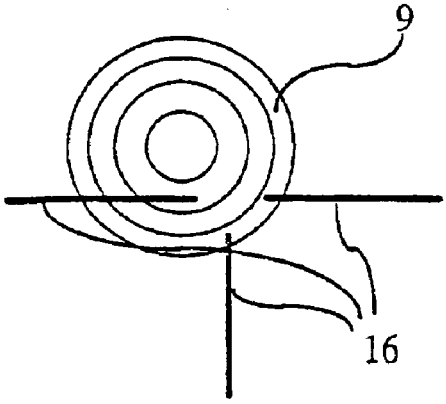
FIG. 2 shows two images with alignment marks and the guide mark of the sight before (FIG. 2*a*) and after (FIG. 2*b*) adjustment.

The alignment device is attached during the alignment procedure, so that the prism device on the simulator and any illumination of the reticle 13 that is required are activated. This means that a stable image of the reticle 13—the alignment mark 9—is obtained in the sight 3. See FIG. 2*a*, in which the sighting mark 16 of the sight 3 is also shown.

Figure 2B:
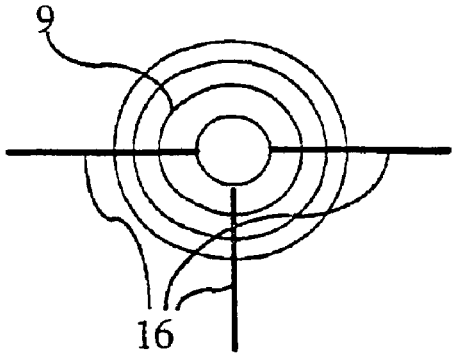

A means of adjustment (not shown) is linked to the adjustment device of the simulator with which the alignment axis (and thus also the simulator axis) can be influenced. Adjustment screws are usually used. The alignment mark 9 can now be moved by these adjustment screws within the sight 3 so that co-alignment of the alignment axis 7 (and thus the simulator axis 5) and the sighting axis 8 can be achieved. (FIG. 2*b*).

Figure 3:
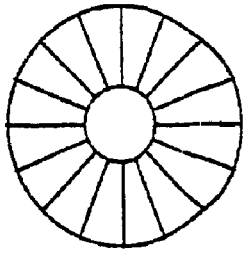
FIG. 3 illustrates an alternative appearance of the alignment mark.

In some cases only a part of the alignment reticle will be visible in the sight 3. The visible part must then indicate how the adjustment screws are to be turned in order to achieve co-alignment. Several different embodiments of the alignment reticle 13 are possible. One further example is shown in FIG. 3. The alignment mark 9 can include arrows or other equivalent graphical symbols that clearly indicate the directions for turning the means of adjustment. In cases where it is only of interest to observe the alignment mark 9 in association with the adjustment, it can be an advantage to be able to remove from the simulator 1 those parts that are only required during the alignment. If a returning prism is used, it is natural to be able to remove this easily and store it separately. An alternative is that it may be folded into the simulator so that it is better protected.

In those cases in which the prism is removed, it is an advantage if the parts of the mechanical adjustment device can be removed that would otherwise be liable to damage when the simulator is used in the field.

It is then appropriate that the removable units are built together to form a module. Electronic circuits associated with the alignment method can then be included in this module, for example, the circuits to activate illumination of the reticle and the circuits to define such simulator properties for the weapon as laser power, to define the range of the weapon, and code parameters, in those cases in which the simulator provides codes specific for the weapon during the simulation.

In those cases in which it is desired to check the alignment during operational use, it can be appropriate to have a semi-transparent prism column, and that only a part of the common light emitted from the optical system is directed to the prism column. In this case, the alignment mark 9 can be allowed to light up, for example, on each shot fired. It thus becomes visible in the sight 3 and can be used as an indication that the simulator simulates and that the alignment is correct.

It is also possible to use the actual simulator beam 4 as the alignment beam 6 by allowing the normally invisible simulator beam 4 to hit a wavelength converter which converts the simulator beam 4 to visible light. It can be particularly appropriate to use a wavelength converter material (30) as a projection screen (not shown) in the collimator in cases in which a collimator is used to return the simulator beam, the wavelength converter then generates a visible mark that specifies the direction in which the simulator beam exits from the simulator.

Figure 9:
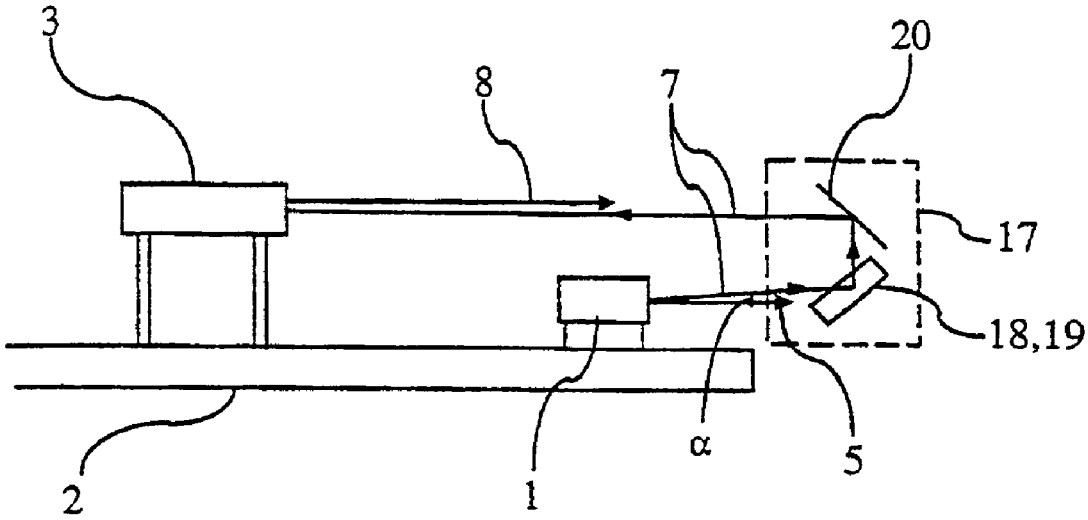
FIG. 9 shows a general version of the simulator with a fixed angle between the simulator axis and the alignment axis.

A more general version of the simulator 1 according to the aspect of the invention is shown in FIG. 9. The difference that characterises this version of the simulator in relationship to the one that has just been described is that the alignment axis 7 is allowed to deviate by a fixed angle α from the simulator axis 5. If the said fixed angle α is known, the reflection device 17 can be designed so that the alignment axis is parallel to the simulator axis 5 after passage through the reflection device, and can thus be used to align the simulator to the sight of the weapon. The fixed angle between the simulator axis and the alignment axis is maintained during the adjustment. Such an arrangement is shown in FIG. 9, in which the simulator 1 is attached to a weapon 2. The simulator emits a simulator beam 4 in the form of a laser lobe, in the same way as described above, the axis of symmetry of which is used as the simulator axis 5, and a visible alignment beam 6 along the alignment axis 7, where the simulator axis and the alignment axis form a known angle α to each other. A reflection device 17 is introduced during adjustment into the pathway of the simulator beam and the alignment beam in order to make the alignment beam visible in the sight. A general example of such a reflection device 17 includes three mirrors 18, 19 and 20, and is shown in FIG. 9. The first mirror 18 and the second mirror 19 function as a roof prism and redirect at the same time the alignment beam 6 by an angle of essentially 90° in the vertical direction (in this example). A third mirror 20 is arranged at such a distance from the first two mirrors 18, 19 and at such a chosen angle to the first two mirrors 18, 19 that the alignment beam 6 is returned to the sight 3 with its alignment axis 7 parallel to the simulator axis 5 after compensation for the known angle α. The alignment mark 9 can thus be observed in the sight, after which the alignment can be adjusted. Three mirrors with an angle exactly or close to 90° between them provide a friction that does not critically depend on their mounting relative to the simulator. This is why the roof prism function is used. The mirrors can consist of polished and mirror-coated (or total reflecting) external surfaces of a glass prism, giving a stable construction.

Figure 10:
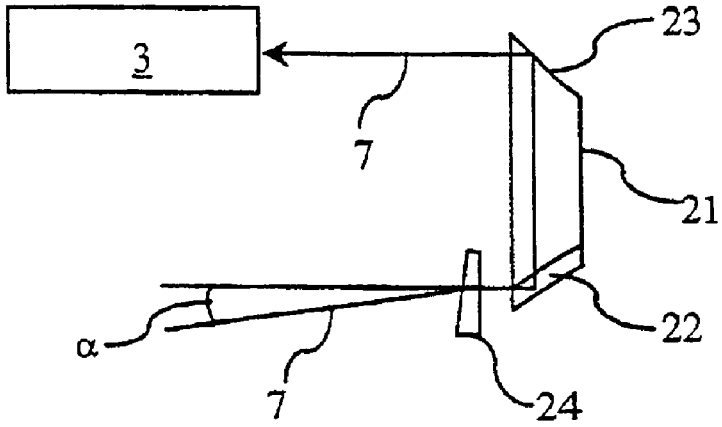
FIG. 10 shows a means of reflection used to return the alignment beam to the sight, for a general version of the simulator.

An alternative method for compensating for the angle α is to use a reversing prism 21, 21 with first reflecting surface 22 and a second reflecting surface 23, which has mutual angles of exactly 90° between the three mirror surfaces, and in which the incident and reflected beams are parallel, together with an optical wedge 24, as shown in FIG. 10. The function of the optical wedge is to compensate for the angle α.

What is claimed is:

1. An alignment device for alignment of a weapon with a weapon simulator mounted on the weapon, wherein the weapon is provided with a sights oriented along a sighting axis and wherein the weapon simulator is equipped with a first device arranged to emit an electromagnetic simulator beam exiting along a simulator axis, the alignment device comprising:

a second device mounted on the weapon arranged to generate an alignment beam along an alignment axis, wherein the angle between the simulator axis and the alignment axis is fixed and known;

a reflection device arranged to reflect the alignment beam into the sight; and means of adjustment arranged to collectively guide the alignment axis and the simulator axis during the alignment of the simulator axis with the sights so that the axes during the alignment maintain the fixed relative angular relationship whereby a user looking through the sights can ensure that the sighting and simulator axes are codirectional.

2. The alignment device according to claim 1, wherein the reflection device comprises a first mirror and a second mirror that function as a roof prism and deflect the alignment beam by 90° and a third mirror placed at such a distance from the first and second mirrors and at such an angle relative to them that the alignment beam is reflected into the sights with the alignment axis parallel to the simulator axis.

3. The alignment device according to claim 1, wherein the reflection device comprises a prism with first reflecting surfaces and a second reflecting surface arranged at such an angle relative to each other that the alignment beam is deflected back into the sights with the alignment axis parallel to the simulator axis.

4. The alignment device according to claim 3, wherein the prism comprises a transparent part at least at the line of sights of the sight, whereby aiming can still be carried out even though the prism is placed in or in front of the sight.

5. The alignment device according to claim 1, wherein the reflection device comprises a reversing prism dimensioned so that the alignment beam is deflected back into the sight, and where an optical wedge is arranged in the pathway of the alignment beam by the reversing prism, whereby the optical wedge refracts the alignment beam so that the alignment axis at the sights becomes parallel with the simulator axis.

6. The alignment device according to claim 1, wherein the fixed angle between the simulator axis and the alignment axis is zero degrees, that is, the axes are mutually parallel.

7. The alignment device according to claim 6, wherein the alignment beam and the simulator beam exit in the same direction and wherein the reflection device reflects the alignment beam in the opposite direction.

8. The alignment device according to claim 7, wherein the reflection device comprises a projection screen.

9. The alignment device according to claim 7, wherein the reflection device comprises a collimator.

10. The alignment device according to claim 7, wherein the reflection device comprises a reversing prism column.

11. The alignment device according to claim 10, wherein the reversing prism column comprises a transparent part at least in the line of sights of the sight, whereby aiming can be carried out despite the fact that the reversing prism column is placed in or in front of the sight.

12. The alignment device according to claim 1, wherein a reticle is arranged in the beam path of the alignment beam in the focal plane of an optical system.

13. The alignment device according to claim 12, wherein the reticle is illuminated with the aid of means for guiding ambient light to the reticle.

14. The alignment device according to claim 12, wherein the reticle is illuminated by an artificial light source.

15. The alignment device according to claim 12, wherein an alignment mark of the reticle is designed with graphical symbols, such as arrows or equivalent pointers, so that it gives a graphical guidance in which direction the means of adjustment must be set when alignment is to be carried out.

16. The alignment device according to claim 1, wherein the alignment beam and the simulator beam have common focussing optical elements for their focussing.

17. The alignment device according to claim 16, wherein the alignment beam and the simulator beam are generated by components that are mechanically attached to each other in the focal plane of the common optical system.

18. The alignment device according to claim 1, arranged in a module demountable from the simulator.

19. The alignment device according to claim 18, wherein the demountable module includes at least one of the second device, the reflection device and a reticle.

20. The alignment device according to claim 19, wherein the demountable module includes parts of the means of adjustment.

21. A weapon simulator mountable on a weapon with a sight, said weapon simulator comprising a first device arranged to emit an electromagnetic simulator beam exiting along a simulator axis and the alignment apparatus according to claim 1.

22. A weapon having a sights and provided with a weapon simulator and the alignment device according to claim 1.

23. A method of alignment of a weapon by using an alignment device with a weapon simulator mounted onto the weapon, wherein the weapon is provided with a sights oriented along a sighting axis, the method comprising:

emitting with the simulator an electromagnetic simulator beam by a first device of the weapon simulator that exists along a simulator axis;

generating with the simulator an alignment beam along an alignment axis by a second device of the alignment device, which forms a fixed and known angle relative to the simulator axis;

collectively guiding the alignment axis and the simulator axis with a means of adjustment so that the axes during an alignment or during an adjustment of the alignment maintain the fixed relative angular relationship to each other; and adjusting the alignment axis to be parallel with a sighting axis of a sights of the weapon whereby a firer looking through the sights can ensure that the sighting and simulator axes are codirectional.

24. The method according to claim 23, wherein the simulator beam is caused to be reflected from a wavelength converter material, whereby visible light is emitted and used as the alignment beam.

25. The method according to claim 23, wherein the alignment beam produces an alignment mark that becomes visible to the firer when the sights of the weapon is used.

26. The method according to claim 25, wherein the alignment mark is made visible only in association with the conduct of an alignment or a check of the alignment.

27. The method according to claim 25, wherein the alignment mark is made visible in association with every shot fired by the weapon so that the firer obtains confirmation that a simulation shot has been fired and that the alignment is still correct.

28. The method according to claim 23, wherein the alignment beam and the simulator beam are focused by the same optical components.

* * * * *